US006682248B2

(12) United States Patent
Lockhart

(10) Patent No.: US 6,682,248 B2
(45) Date of Patent: Jan. 27, 2004

(54) REPORT FOLDER

(76) Inventor: William E. Lockhart, 9610 Skillman, Dallas, TX (US) 75243

( * ) Notice: Subject to any disclaimer, the term of this patent is extended or adjusted under 35 U.S.C. 154(b) by 0 days.

(21) Appl. No.: 10/072,211

(22) Filed: Feb. 7, 2002

(65) Prior Publication Data

US 2002/0131811 A1 Sep. 19, 2002

Related U.S. Application Data

(60) Provisional application No. 60/276,270, filed on Mar. 15, 2001.

(51) Int. Cl.[7] ..... B42F 13/00

(52) U.S. Cl. ..... 402/73; 402/70; 281/29; 281/37; 281/45

(58) Field of Search ..... 281/15.1, 21.1, 281/29, 36, 37, 45, 51; 402/70, 73, 4, 80 R

(56) References Cited

U.S. PATENT DOCUMENTS

| | | | | | |
|---|---|---|---|---|---|
| 1,439,138 | A | | 12/1922 | White | 281/1 |
| 1,614,977 | A | | 1/1927 | Ausmus | 281/33 |
| 3,111,126 | A | | 11/1963 | Brinkmann | 402/14 |
| 4,240,761 | A | | 12/1980 | Jacobson | 402/76 |
| 4,548,426 | A | | 10/1985 | Lockhart | 281/29 |
| 4,706,994 | A | | 11/1987 | Lockhart | 281/29 |
| 5,219,437 | A | * | 6/1993 | Moor et al. | 281/29 |
| 5,236,226 | A | | 8/1993 | Sheffield | 281/48 |
| 5,330,281 | A | * | 7/1994 | Kalan | 281/15.1 |
| 5,351,992 | A | | 10/1994 | Chilson et al. | 281/31 |
| 5,407,230 | A | | 4/1995 | Brink et al. | 281/15.1 |
| 6,149,200 | A | | 11/2000 | Lockhart | 281/29 |
| 6,371,679 | B1 | * | 4/2002 | Peleman | 402/73 |

FOREIGN PATENT DOCUMENTS

| | | | | |
|---|---|---|---|---|
| AT | 127964 | | 12/1931 | 281/29 |
| GB | 842594 | | 7/1960 | 282/22 R |
| IT | 456901 | | 4/1950 | 281/29 |
| WO | WO 89/01645 | * | 2/1989 | 281/37 |

OTHER PUBLICATIONS

Page 579 Office Depot Office Supplies Book Spring 2001.

* cited by examiner

*Primary Examiner*—Willmon Fridie, Jr.
(74) *Attorney, Agent, or Firm*—Thompson & Gustavson, L.L.P.

(57) ABSTRACT

A report cover (10) is disclosed which can be used with a report (12) bound by a flexible comb binding (14). An insert (20) is bound with the report (12) in the flexible comb binding (14). The insert (20) is then fit within a pocket (38) in the back cover (28) of the cover (26). The spine or side cover (30) and front cover (32) of the cover (26) then encloses the report (12) and spiral binding (14) to provide an attractive final report appearance. The report cover can be used with a report that is bound with a spiral, wire loop or three ring binding also.

20 Claims, 5 Drawing Sheets

REPORT FOLDER

CROSS REFERENCE TO RELATED APPLICATION

This application claims priority from Provisional Patent Application Ser. No. 60/276,270 filed Mar. 15, 2001.

TECHNICAL FIELD

This invention relates to a report cover for containing a report or other documents.

BACKGROUND OF THE INVENTION

Many methods have been developed to bind reports and other documents. One common method is the use of the flexible comb binding as sold by GBC Co. This binding has a plastic backing from which extends a series of adjacent plastic loops which each have an unattached, free end. The resiliency of the loops causes the free ends to curl in a circle to engage the backing to effectively form a closed loop. The documents to be bound are punched with rectangular holes along the inner edge of the documents to permit a loop to pass through each hole. A machine available from GBC and other sources is employed to open up the loops sufficiently to allow a person to fit the documents onto the loops. The machine then allows the loops to close, effectively binding the report.

The flexible comb binding comes in a variety of sizes, depending on the thickness of the document. However, it is common to use a binding having a larger diameter than the thickness of the document itself, resulting in the comb binding interfering with the normal use, appearance and storage of the document. For example, it is difficult to stack a series of documents bound by such a flexible comb binding as the binding has a greater diameter than the document thickness. Also, the flexible comb binding can catch on edges and interfere with the operation of the report and the plastic loops often pull apart from the document cover and sheets. Unlike conventionally bound books with titles printed on their spines, plastic comb binding makes spine titling very difficult. Without the title printed on the spine of a report, the report can't be identified from its edge.

Other bindings are common as well. Spiral binding is, literally, spiral wire or plastic coils which bind, for example, school writing pads and many reports bound by professional binderies. Spiral bindings, both metal and plastic, use round holes in the documents being bound. Another binding is metal loops or loop wire binding. A twin loop wire binding is common on planners.

All of these methods of binding perform the function of permitting the turning of pages in the bound report. However, the bindings are exposed and are thicker than the report itself, so that the reports can't be stacked flat like books. None of the binding methods provide for convenient spine titling, making filing, finding and retrieval of the report more difficult.

SUMMARY OF THE INVENTION

In accordance with one aspect of the present invention, a report cover is provided which includes a first member which has a series of holes therein to receive a flexible binding, the flexible binding holding a report therein. A second member has a back cover with a pocket, a side cover hingably connected to an edge of the back cover and a front cover hingably connected to an edge of the side cover. The first member engages the pocket in the second member. The second member encloses the flexible binding and the report to bind the report and provides a spine which may be titled for easy shelf retrieval.

BRIEF DESCRIPTION OF THE DRAWINGS

A more complete understanding of the invention and its advantages will be apparent from the following Detailed Description when taken in conjunction with the accompanying Drawings, in which.

DETAILED DESCRIPTION

Figure 1:
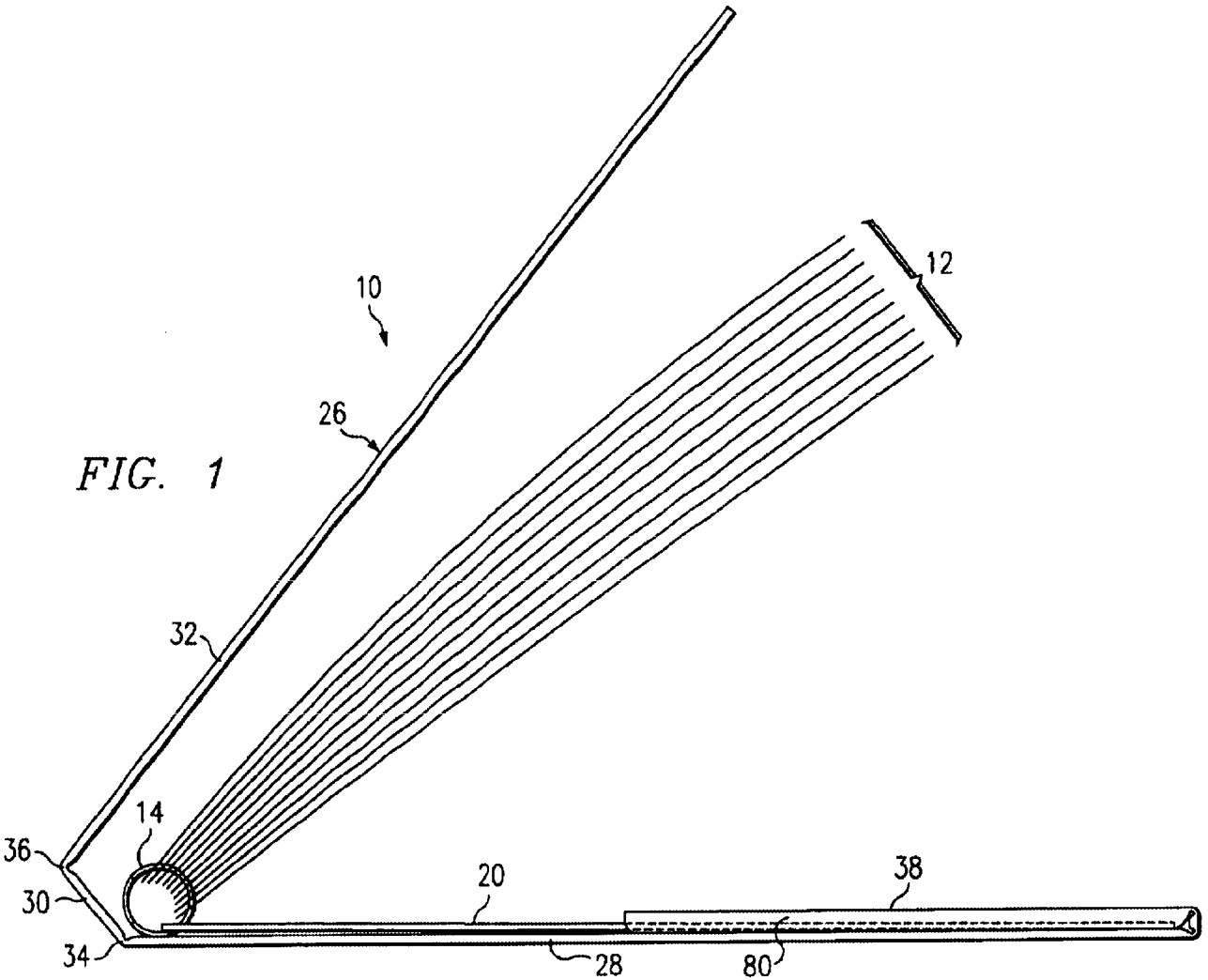
FIG. 1 is a side cross sectional view of a report cover forming a first embodiment of the present invention.

Referring now to the drawings, wherein like reference characters designate like or corresponding parts throughout the several views, a report cover 10 forming a first embodiment of the invention will be described. The report cover 10 will be used to enclose a report or document 12 which is bound by the conventional, well-known flexible comb binding 14. Comb binding 14 of this type is sold by GBC Co. Such comb bindings can be purchased, for example, through Office Depot in their office supplies Big Book of spring 2001 on page 579. While the report cover will be illustrated and described for use with a comb binding, it should be understood that the report cover 10 can also be used with other types of binding, such as spiral binding, wire loop binding and twin wire loop binding to achieve the same advantages.

Figure 3:
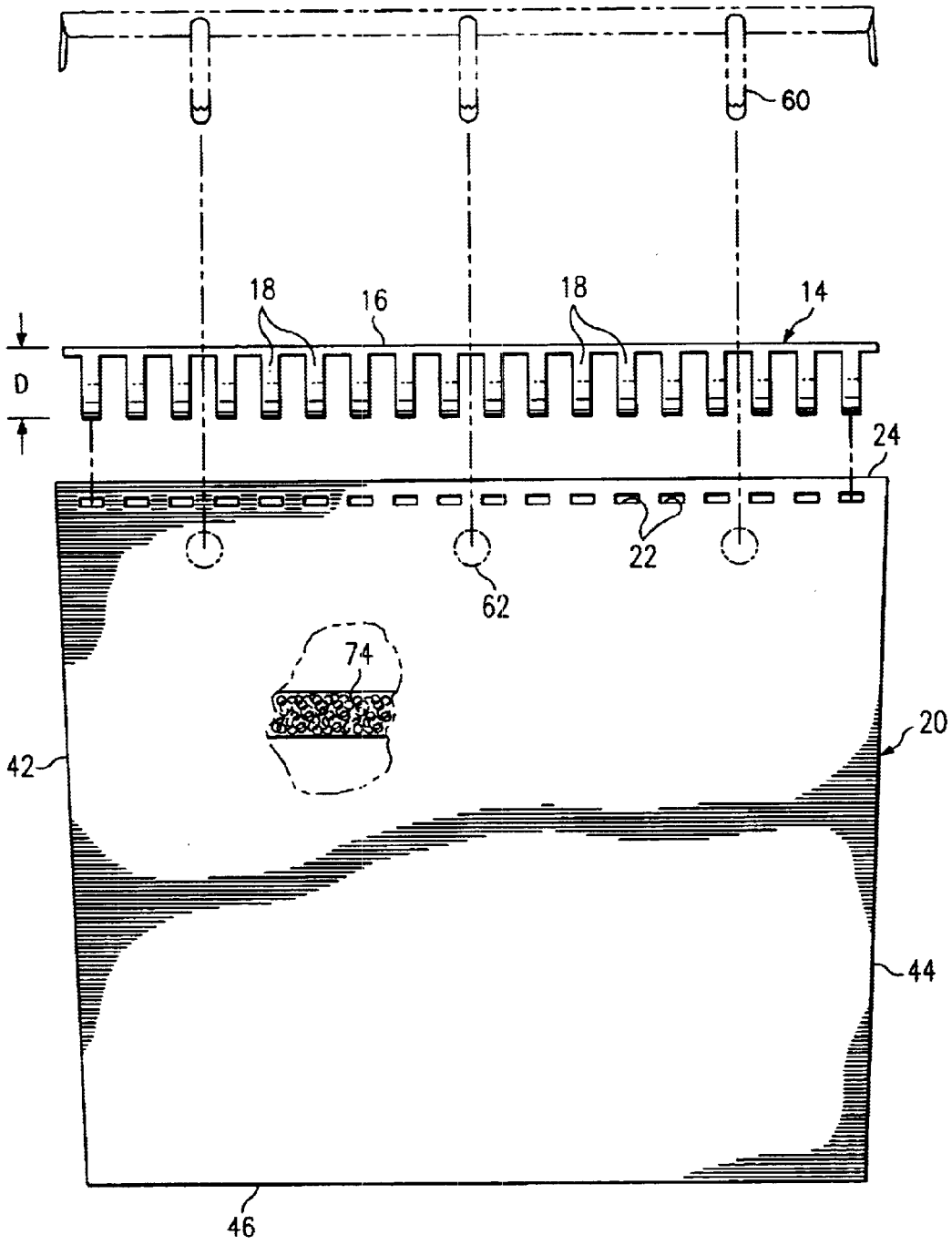
FIG. 3 is a plan view of the insert of the report cover and a flexible comb binding.

GBC makes the flexible comb binding 14 from PVC plastic and, referring to FIG. 3, the comb binding 14 will commonly have a backing 16 and a series of nineteen plastic rings 18. One end of each ring is formed integrally with the backing 16 and the other end is free. The natural resiliency of the rings 18 is such that the free end will typically curve around and engage the backing 16 to form a closed loop. GBC sells such flexible comb bindings in a variety of diameters to accommodate the thickness of a particular document and report, which is usually determined by the number of pages in the report. For example, flexible comb bindings are sold by GBC in diameters of ¼ inch (manufacturer's number IBC 18242), 5/16 inch, ⅜ inch, ½ inch, ⅝ inch, ¾ inch, 1 inch, 1½ inch and 2 inch (manufacturer's number IBC15322). A ¼ inch diameter flexible comb binding is designed to accommodate a report of 20 pages while a 1 inch diameter comb binding is designed to accommodate 200 pages, for example.

As noted, the use of a comb binding 14 to bind a report often results in an awkward assembly. A sufficiently large diameter flexible comb binding 14 must be chosen to bind the report in order to provide ease of turning pages. However, this often results in a larger diameter flexible comb binding 14 than the thickness of the report. This leads to problems stacking reports and using them because of the awkwardness of the flexible comb binding 14. As will be explained, the report cover 10 resolves all of these problems, provides an excellent final appearance to the report and has a "spine" surface for report titling to allow rapid viewing and access when the report is stored on shelves or in drawers.

The report cover 10 includes an insert 20 which is made of a relatively rigid material, such as a multiple ply cotton bond. Insert 20 can be 260 lb board, for example. Suitable rectangular holes 22 are formed along a first edge 24 of the insert, sized to receive the rings 18 of the flexible comb binding 14. (if report cover 10 was used with a spiral binding, the holes 22 would be round) For example, when using the common PVC plastic binding 14 with nineteen rings, nineteen holes 22 will be formed along the first edge 24, each hole receiving a ring 18. As the user opens the rings 18 on the flexible comb binding 14 to place the report 12 thereon, the user will also place the insert 20 on the binding so that it is at the back of the report.

Figure 4:
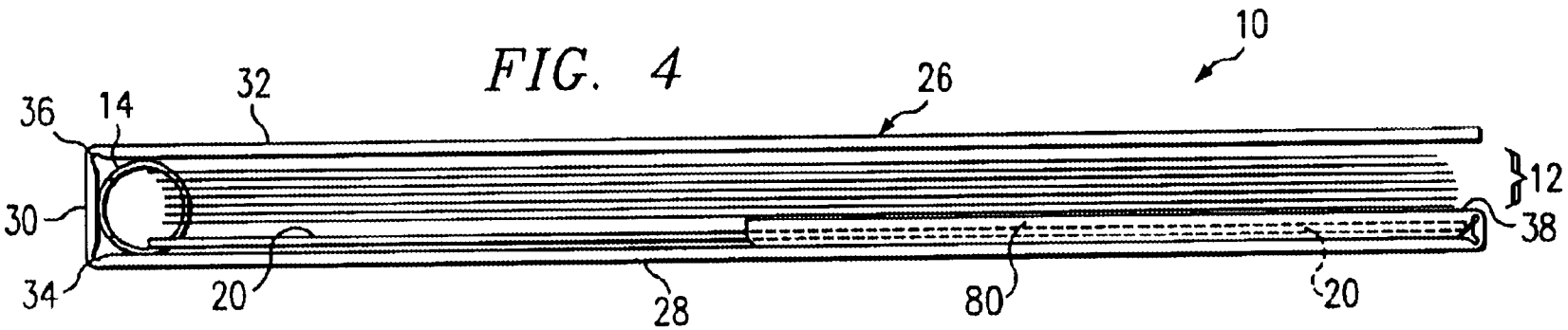
FIG. 4 is a cross sectional view of the report cover closed over the report and flexible comb binding.
Figure 5:
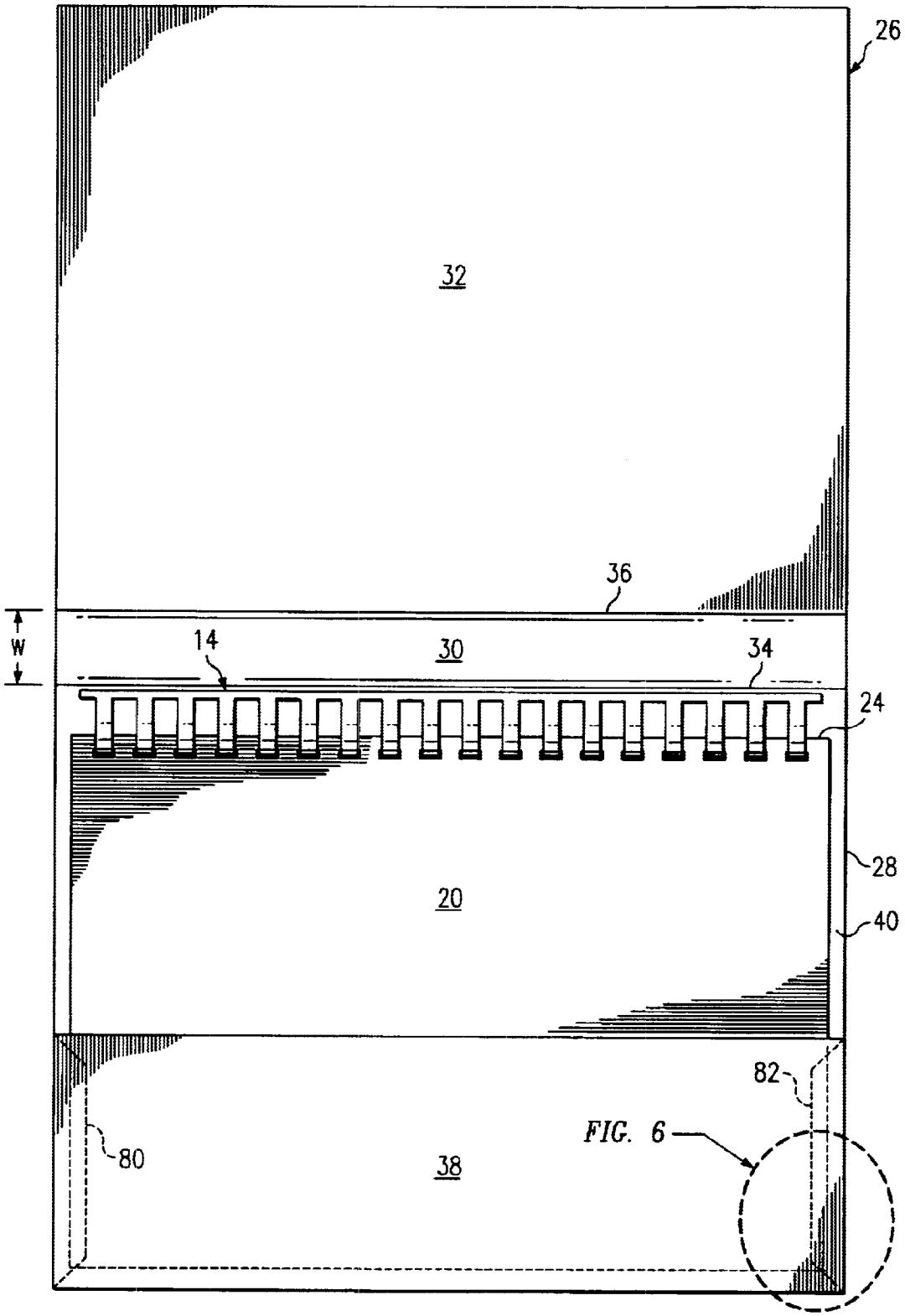
FIG. 5 is a plan view of the cover portion, insert and flexible comb binding assembled, without the report.

The report cover 10 also includes a cover 26, which includes a back cover 28, a side spine cover 30 and a front cover 32. The cover 26 is preferably formed of a single piece of material, such as multiple ply cotton bond, which forms folding hinges 34 and 36 between the back cover 28 and side cover 30 and between the side cover 30 and the front cover 32. A pocket 38 is formed on the inside 40 of the back cover 28 to receive a portion of the insert 20, as seen in FIGS. 1 and 5. This will hold the report 12 and flexible comb binding 14 within the cover 26. The width W of the side cover 30 is designed to be as wide or slightly wider than the diameter D of the flexible comb binding 14. Thus, as seen in FIG. 4, the report cover 10 will surround and enclose the report 12 and flexible comb binding 14 to bind and protect the report 12 and the binding 14, while eliminating the prior disadvantages in use of the flexible comb binding 14. As can be understood, it will be easier to stack a series of reports within report covers 10 using the flexible comb binding 14. Further, the flexible comb binding 14 will no longer be exposed to interfere with use of the report 12. Also, the report cover 10 provides a very attractive and professional final appearance to the document 12. With a "book-like" spine formed by side cover 30, the report cover 10 can be titled for easy retrieval while stacked, standing or filed in drawers.

Figure 2:
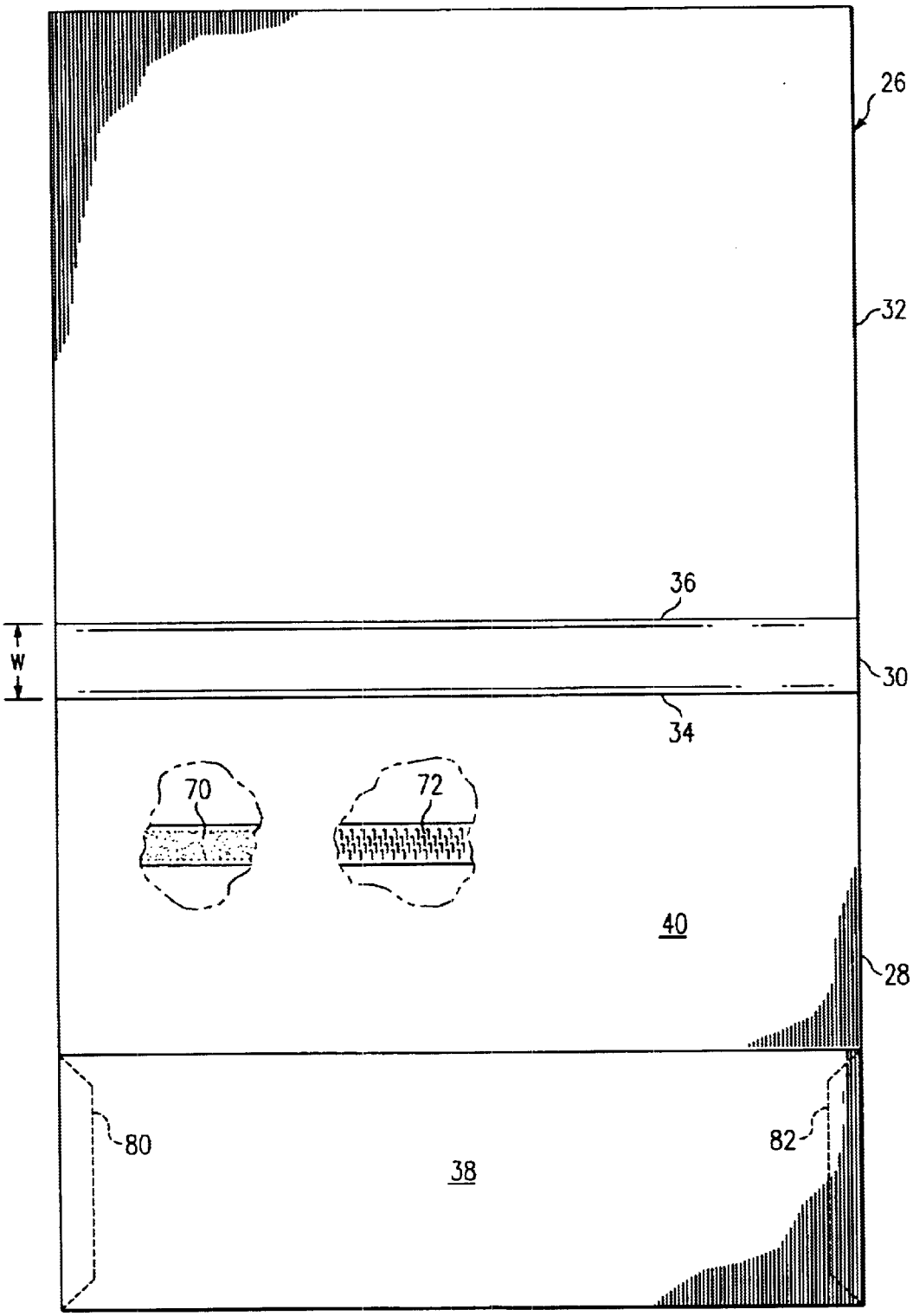
FIG. 2 is a plan view of the cover portion of the report cover.
Figure 6:
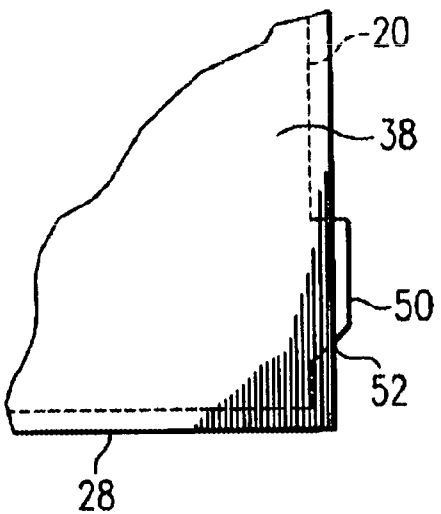
FIG. 6 is a detail view of an optional tab and receiver to hold the insert and report in the cover.

The edges 42 and 44 of the insert 20 can be slightly tapered toward the edge 46 opposite first edge 24 as seen in FIG. 3. This can act to wedge the insert 20 within the pocket 38 to resist shifting of the report 12 within the report cover 10. As illustrated in FIG. 6, a tab 50 can be formed on the insert 20 to engage a receiver 52 in the pocket to provide a physical engagement of the insert 20 with the pocket 38 to resist removal of the report 12. An edge of the tab 50 can also be slightly tapered as seen in FIG. 6 to provide a wedging action between the tab 50 and receiver 52. Alternatively, the insert 20 can be adhesively secured to the back cover 28 by a suitable adhesive 70 as seen in FIG. 2, or secured by a Velcro hook 72 and loop 74 attachment as seen in FIGS. 2 and 3 or other suitable mechanism to hold the insert 20 within the pocket 38 of the cover 26.

The pocket 38 can be formed as a separate piece from the cover 26 and then glued or otherwise secured to the back cover 28. If a separate piece, the pocket will preferably have foldable tabs at three edges thereof which are folded inwardly and secured to cover 26 to provide a suitable pocket to receive insert 20. Alternatively, the pocket 38 can be formed as an integral piece of the cover 28 by suitably die cutting the cover 26 with the pocket 38 which can be folded into the final position and secured thereto by adhesive. When formed integral with the cover 26, the pocket 38 has side tabs 80 and 82 which can be folded inwardly and secured to the cover 28 to provide the pocket as seen in FIGS. 1, 2, 4 and 5. An advantage of a pocket 38 formed from a separate piece is that the pocket can be made of lighter weight material than the cover 26. The tabs can be secured to back cover 28 by an adhesive covered by a peelable strip until use, glue or any other suitable securing technique.

As noted, while report cover 10 is illustrated for use with a flexible comb binding, other binding mechanisms such as spiral coils or twin loop wires can be used with report cover 10. Also, a conventional three-ring binder element 60 as shown in the inset in FIG. 3 can be secured to insert 20. The report cover 10 would provide the advantage of enclosing the three-ring binder element in the same manner as the flexible comb binding 14. If a three-ring binder element were to be used, the three-ring binder element could be riveted to the insert 20 in the same manner that the conventional three-ring binder element is riveted onto the back of the conventional three ring binder cover, glued thereto or otherwise secured to the insert 20. Alternatively, insert 20 could have holes 62 formed therein as illustrated in dotted line in FIG. 3 to fit the three rings of the binder 60.

While a single embodiment of the present invention has been illustrated in the accompanying drawings and described in the foregoing Detailed Description, it will be understood that the invention is not limited to the embodiment disclosed, but is capable of numerous rearrangements, modifications and substitutions of parts and elements without departing from the scope and spirit of the invention.

What is claimed is:

1. A report cover for binding a report, comprising:

a first member having a series of holes therein to receive a binding, the binding holding a report therein;

a second member having a back cover with a pocket, a side cover hingably connected to an edge of the back cover and a front cover hingably connected to an edge of the side cover, the first member engaged in the pocket, the second member enclosing the binding and report, the second member and pocket being formed of a single die cut piece of material, the pocket having a plurality of side tabs folded inwardly and secured to the back cover.

2. The report cover of claim 1 wherein the binding is a flexible comb, spiral or wire loop binding, the second member enclosing the binding and report.

3. The report cover of claim 1 wherein the binding is a three ring binding, the second member enclosing the three ring binding and report.

4. The report cover of claim 1 wherein the first member has first and second edges, the edges tapered relative each other to wedge into the pocket of the second member.

5. The report cover of claim 1 wherein the first member has a tab, the second member having a receiver receiving the tab when the first member is engaged in the pocket.

6. The report cover of claim 1 wherein the side cover of the second member defines a width, the binding defining a diameter, the width of the side cover exceeding the diameter of the binding.

7. The report cover of claim 1 further comprising adhesive, wherein the first member is adhesively secured in the pocket when the first member engages the pocket.

8. The report cover of claim 1 further comprising a hook and loop attachment wherein the first member is secured in the pocket by the hook and loop attachment when the first member engages the pocket.

9. The report cover of claim 1 wherein the material is multiple ply cotton bond.

10. A method for binding a report in a report cover, comprising the steps of:

binding the report and a first member with a binding;

inserting the first member in a pocket of a back cover of a second member, the second member having a side cover hingably connected to an edge of the back cover and a front cover hingably connected to an edge of the side cover, the back cover, side cover and front cover formed of a single piece of material;

folding the side cover and front cover about the hinges to fold the side and front covers over the report to enclose the report; and securing the first member in the pocket with adhesive or a hook and loop attachment.

11. The method of claim 10 further comprising the step of forming a series of holes in the first member to receive the binding.

12. A method for binding a report in a report cover, comprising the steps of:

binding the report and a first member with a binding;

inserting the first member in a pocket of a back cover of a second member, the second member having a side cover hingably connected to an edge of the back cover and a front cover hingably connected to an edge of the side cover;

folding the side cover and front cover about the hinges to fold the side and front covers over the report to enclose the report; and inserting a tab on the first member into a receiver in the second member as the first member is inserted in the pocket of the second member.

13. A report cover for binding a report, comprising:

a first member having a series of holes therein to receive a binding, the binding holding a report therein;

a second member having a back cover with a pocket, a side cover hingably connected to an edge of the back cover and a front cover hingably connected to an edge of the side cover, the first member engaged in the pocket, the second member enclosing the binding and report, the back cover, side cover and front cover formed of a single piece of material; and an adhesive, wherein the first member is adhesively secured in the pocket when the first member engages the pocket.

14. The report cover of claim 13 wherein the second member is formed of a multiple ply cotton bond.

15. The report cover of claim 13 wherein the second member is formed of a cover portion and a separate pocket portion.

16. The report cover of claim 15 wherein the pocket portion is formed of lighter weight material than the cover portion.

17. A report cover for binding a report, comprising:

a first member having a series of holes therein to receive a binding, the binding holding a report therein;

a second member having a back cover with a pocket, a side cover hingably connected to an edge of the back cover and a front cover hingably connected to an edge of the side cover, the first member engaged in the pocket, the second member enclosing the binding and report, the back cover, side cover and front cover formed of a single piece of material; and a hook and loop attachment, the first member being secured in the pocket by the hook and loop attachment when the first member engages the pocket.

18. The report cover of claim 17 wherein the second member is formed of a multiple ply cotton bond.

19. The report cover of claim 17 wherein the second member is formed of a cover portion and a separate pocket portion.

20. The report cover of claim 17 wherein the pocket portion is formed of lighter weight material than the cover portion.

* * * * *